US007780260B2

(12) United States Patent
Usui

(10) Patent No.: US 7,780,260 B2
(45) Date of Patent: Aug. 24, 2010

(54) INKJET PRINTER AND CAPPING METHOD

(75) Inventor: Takamasa Usui, Ogaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 689 days.

(21) Appl. No.: 11/644,679

(22) Filed: Dec. 22, 2006

(65) Prior Publication Data

US 2007/0176961 A1 Aug. 2, 2007

(30) Foreign Application Priority Data

Dec. 27, 2005 (JP) ..... 2005-375128

(51) Int. Cl.
*B41J 2/165* (2006.01)

(52) U.S. Cl. ..... 347/29

(58) Field of Classification Search ..... 347/29
See application file for complete search history.

(56) References Cited

U.S. PATENT DOCUMENTS

| | | | | |
|---|---|---|---|---|
| 5,504,508 | A * | 4/1996 | Hashimoto | 347/24 |
| 6,209,983 | B1 | 4/2001 | Osborne | |
| 6,520,619 | B1 * | 2/2003 | Murcia et al. | 347/32 |
| 6,773,088 | B2 | 8/2004 | Aldrich | |
| 7,334,863 | B2 * | 2/2008 | Nishi et al. | 347/22 |

FOREIGN PATENT DOCUMENTS

JP 2004-276270 10/2004

* cited by examiner

*Primary Examiner*—Julian D Huffman
*Assistant Examiner*—Jason S Uhlenhake
(74) *Attorney, Agent, or Firm*—Frommer Lawrence & Haug LLP

(57) ABSTRACT

An inkjet printer includes a recording head having a nozzle face provided with a nozzle for discharging an ink to form an image on a recording medium, and a detachable cap for capping the nozzle face. The cap of the inkjet printer is provided with an annular rim and an annular groove, which are provided along a periphery of the cap, the groove being opposed to the nozzle face in a state where the cap is abutted against the nozzle face. In the inkjet printer, a during non-image-forming period, the rim of the cap is abutted against the nozzle face, thus capping the nozzle face.

33 Claims, 10 Drawing Sheets

INKJET PRINTER AND CAPPING METHOD

CROSS-REFERENCE OF RELATED APPLICATION

This nonprovisional application claims priority under 35 U.S.C. §119(a) on Patent Application No. 2005-375128 in Japan on Dec. 27, 2005, the entire contents of which are hereby incorporated by reference.

BACKGROUND

The present invention relates to an inkjet printer and a capping method, and in particular relates to an inkjet printer including a cap that can ensure a high sealing property with a small cap load and a capping method.

Capping of (a nozzle face of) a recording head in an inkjet printer has conventionally been carried out by abutting an upper end of a lip (rim), protruded along an outer edge of a cap, against the nozzle face at which an inkjet nozzle is formed, and by providing a closed space with a cap inner face and the nozzle face. After the capping for covering the nozzle face has been done using the cap, the nozzle is preserved in order to prevent the drying of the nozzle during non-recording time, and purge for the prevention of nozzle clogging is carried out by sucking out a solidified ink, minute dirt and the like from the nozzle.

As the lip provided at the cap, in addition to the lip (rim) for sealing provided at the outer edge of the cap, a partitioning lip (partitioning wall) for allowing ink to be sucked from a nozzle for each kind of ink may be provided (see, for example, Japanese Patent Application Laid-Open No. 2004-276270 (pp. 7-8, and FIGS. 3 and 4)).

The cap load, applied from the cap to the nozzle face when the nozzle face is covered by the cap, causes the deflection of the nozzle face, a head holder and the like, and brings about various adverse effects such as deformation with respect to a precision-made recording part. Therefore, it is preferable that the cap load is small. In particular, in an inkjet printer that allows A3 size paper, the number of nozzles is increased and a nozzle face of a recording head is widely formed in order to raise a recording speed. Accordingly, a large size cap is used, and as a result, the total length of a provided lip becomes large. Therefore, there arises the disadvantage that the cap load that acts upon the nozzle face is increased.

BRIEF SUMMARY

If the load that presses the cap is decreased to reduce the cap load in order to solve this disadvantage, the close contact between the upper end of the sealing lip (rim) and the nozzle face is degraded to reduce the sealing property of the cap. Then, defects arise during purge, and there occurs the trouble that the effect of preserving a nozzle is insufficient, for example.

In view of the above-described problems, an object is to provide an inkjet printer and a capping method which can ensure the sealing property of a cap even if a cap load is small, and enable capping in which the load applied onto a nozzle face, a head holder and the like is small.

To achieve the above object, there is provided an inkjet printer according to an aspect, comprising:

a recording head having a nozzle face provided with a nozzle for discharging an ink to form an image on a recording medium; and a detachable cap for capping the nozzle face, the cap including an annular rim and an annular groove which are provided along a periphery of the cap, the groove being opposed to the nozzle face in a state where the cap is abutted against the nozzle face, wherein during a non-image-forming period, the rim of the cap is abutted against the nozzle face, thus capping the nozzle face.

According to the aspect, the groove is formed at an upper end of the annular sealing lip (rim), thus improving the sealing property of the lip upper end, and reducing a cap load while the sealing property of the cap is ensured. This is because if the upper end of the annular sealing lip is abutted against the nozzle face, the inside of the cap is doubly partitioned by banks located on both sides of the groove, and thus the sealing property within the cap is increased.

The inkjet printer according to the aspect enables the capping in which an adverse effect such as deformation does not occur in precision-made recording components such as a nozzle face and a head holder. Furthermore, since the cap load can be reduced, it is hard for the lip to be adversely deformed even if the nozzle is preserved for a long period of time.

The above and further objects and features will more fully be apparent from the following detailed description with accompanying drawings.

BRIEF DESCRIPTION OF THE SEVERAL VIEWS OF THE DRAWINGS

FIGS. 5A to 5C show diagrams each illustrating the cap of the inkjet printer according to one embodiment, in which FIG. 5A is a cross-sectional view taken along the arrow line x-x in FIG. 3, FIG. 5B is an enlarged view of the A area in FIG. 5A, and FIG. 5C is an enlarged view of the B area in FIG. 5A;

DETAILED DESCRIPTION

Hereinafter, embodiments of an inkjet printer will be described with reference to drawings.

Figure 1:
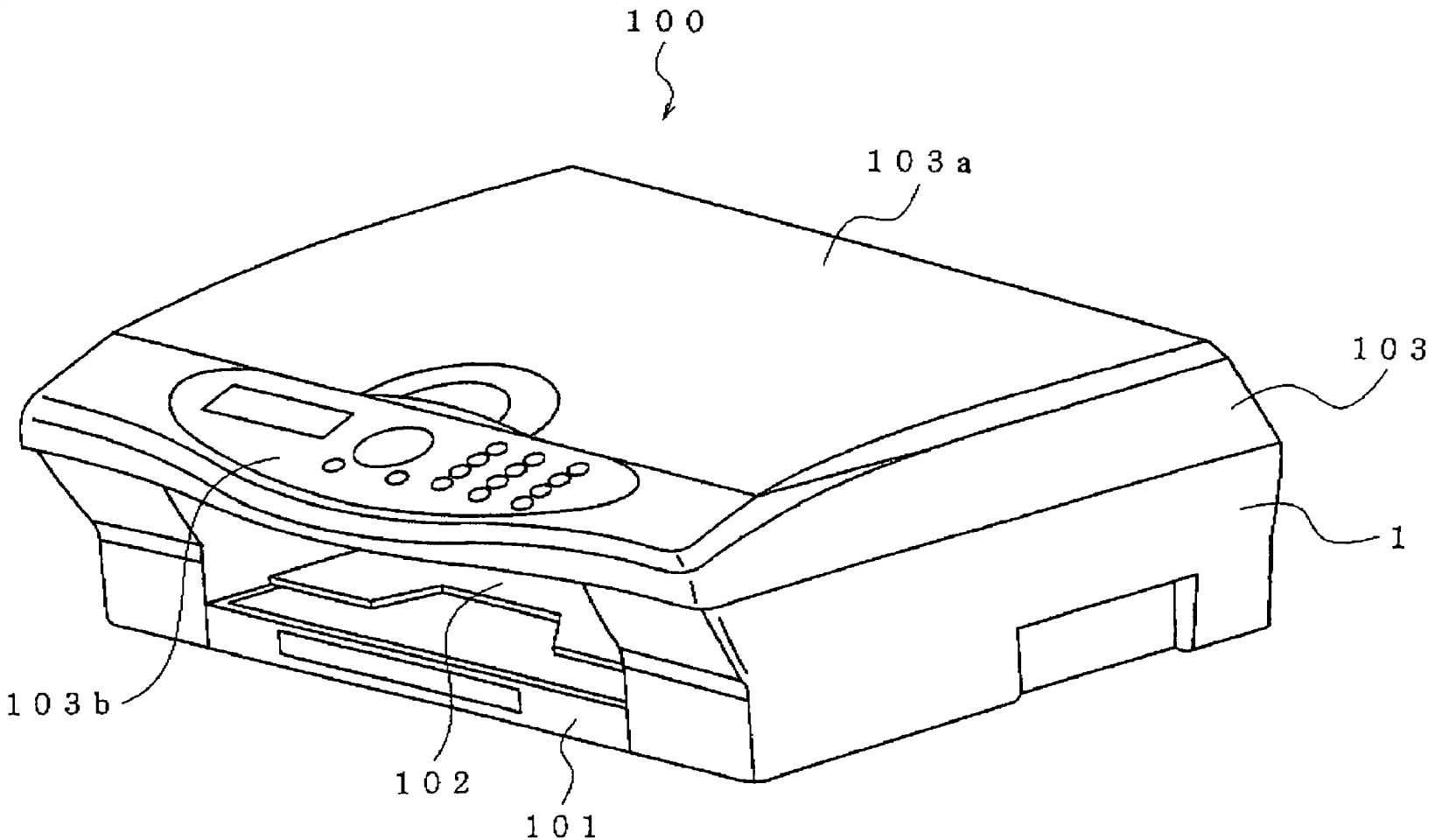
FIG. 1 is a perspective view illustrating an embodiment of a compound machine including an inkjet printer according to one embodiment.

FIG. 1 is a perspective view illustrating an appearance of a thin type A3 compatible compound machine 100 equipped with the functions of a copier, a scanner, a facsimile and the like in addition to an inkjet printer.

The compound machine 100 is provided, at its bottom part, with a paper feed tray 101 that can be drawn frontward. An upper cover of the paper feed tray 101 constitutes a paper discharge tray 102 for receiving discharged papers, and thus the compound machine 100 is of the type in which papers can be fed and discharged in front. The compound machine 100 is further provided, at its upper part, with a manuscript reader 103 that is used in carrying out copying, image scanning, fax transmission and the like, and is provided, at its lower part, with an inkjet printer 1.

Figure 2:
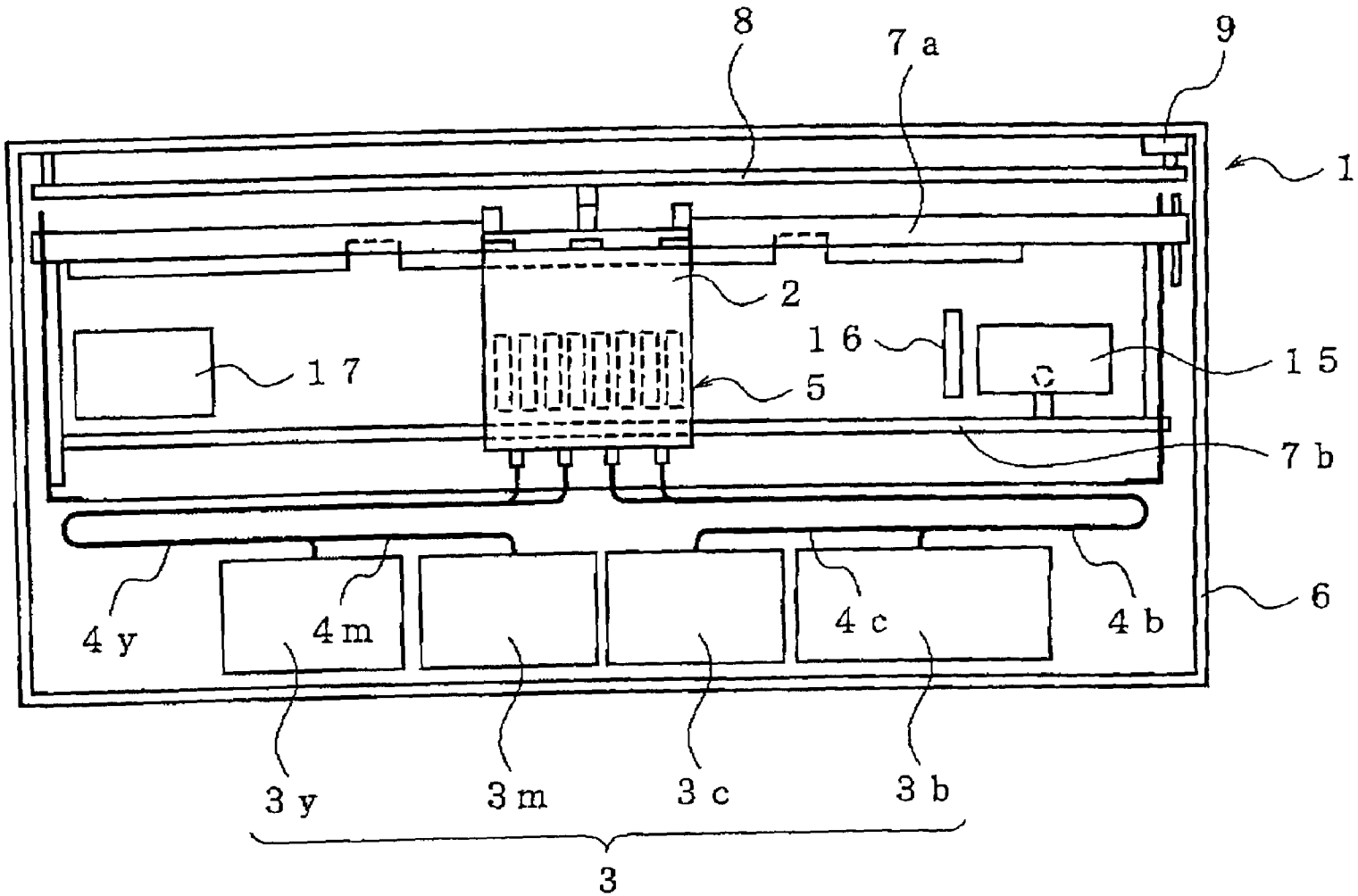
FIG. 2 is a schematic plan view of the inkjet printer according to one embodiment.

The manuscript reader 103 is provided, at its upper face, with a manuscript stand cover 103*a* for holding a manuscript set at a manuscript stand, and an operation panel 103*b*. The manuscript reader 103 can be opened and closed with respect to the lower part of the compound machine 100 so as to enable, for example, the replacement of an ink cartridge for the inkjet printer 1. FIG. 2 is a diagram schematically illustrating an inner part of the inkjet printer 1.

In FIG. 2, the reference numeral 2 denotes a recording head unit provided with a recording head for carrying out recording by ejecting ink onto a paper, and the reference numeral 3 denotes ink cartridges. More specifically, the reference numerals 3*b*, 3*y*, 3*c*, and 3*m* denote ink cartridges for black color, yellow color, cyan color, and magenta color, respectively. The recording head unit 2 is connected to the respective ink cartridges via flexible tubes 4*b*, 4*y*, 4*c*, and 4*m* through which ink is supplied.

The recording head unit 2 is fixed to a carriage 5, and the carriage 5 is slidably attached, in a bridging manner, to two guide shafts 7*a* and 7*b* that are extended in parallel with the longitudinal direction of a main body case 6 and arranged in the widthwise direction of the main body case 6. In the vicinity of the guide shafts 7*a* and 7*b*, an endless timing belt 8 is located so that the rotational direction thereof is in parallel with the longitudinal direction of each of the guide shafts 7*a* and 7*b*. The endless timing belt 8 can be rotated in the forward and reverse direction by a drive motor 9 located at an end of the main body case 6, and the driving of the carriage 5 enables the reciprocating movement of the recording head unit 2, provided at the carriage 5, along the guide shafts 7*a* and 7*b*.

Figure 3:
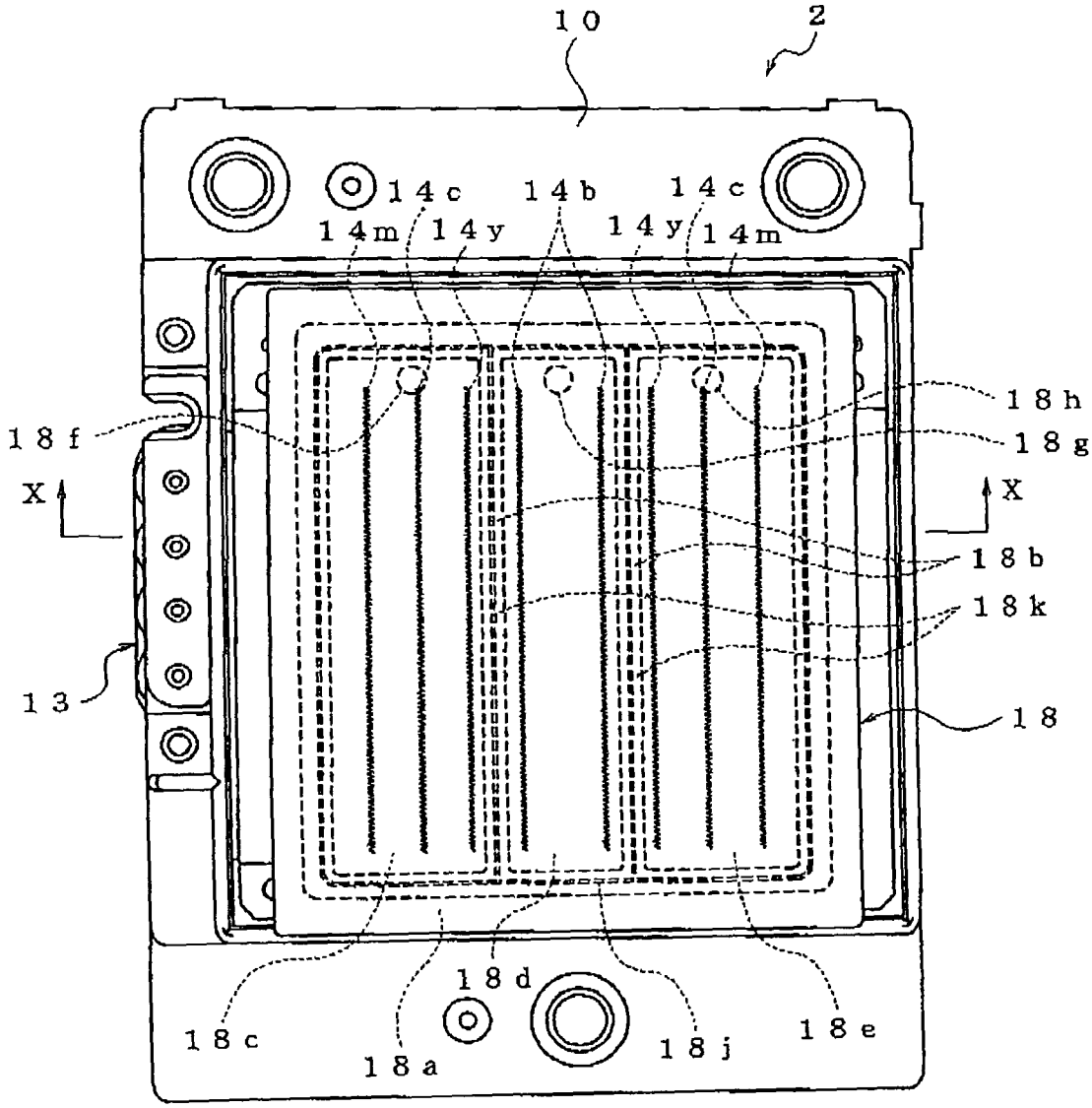
FIG. 3 is a diagram for describing the positional relationship between a nozzle face of a recording head and a cap in the inkjet printer according to one embodiment.
Figure 4:
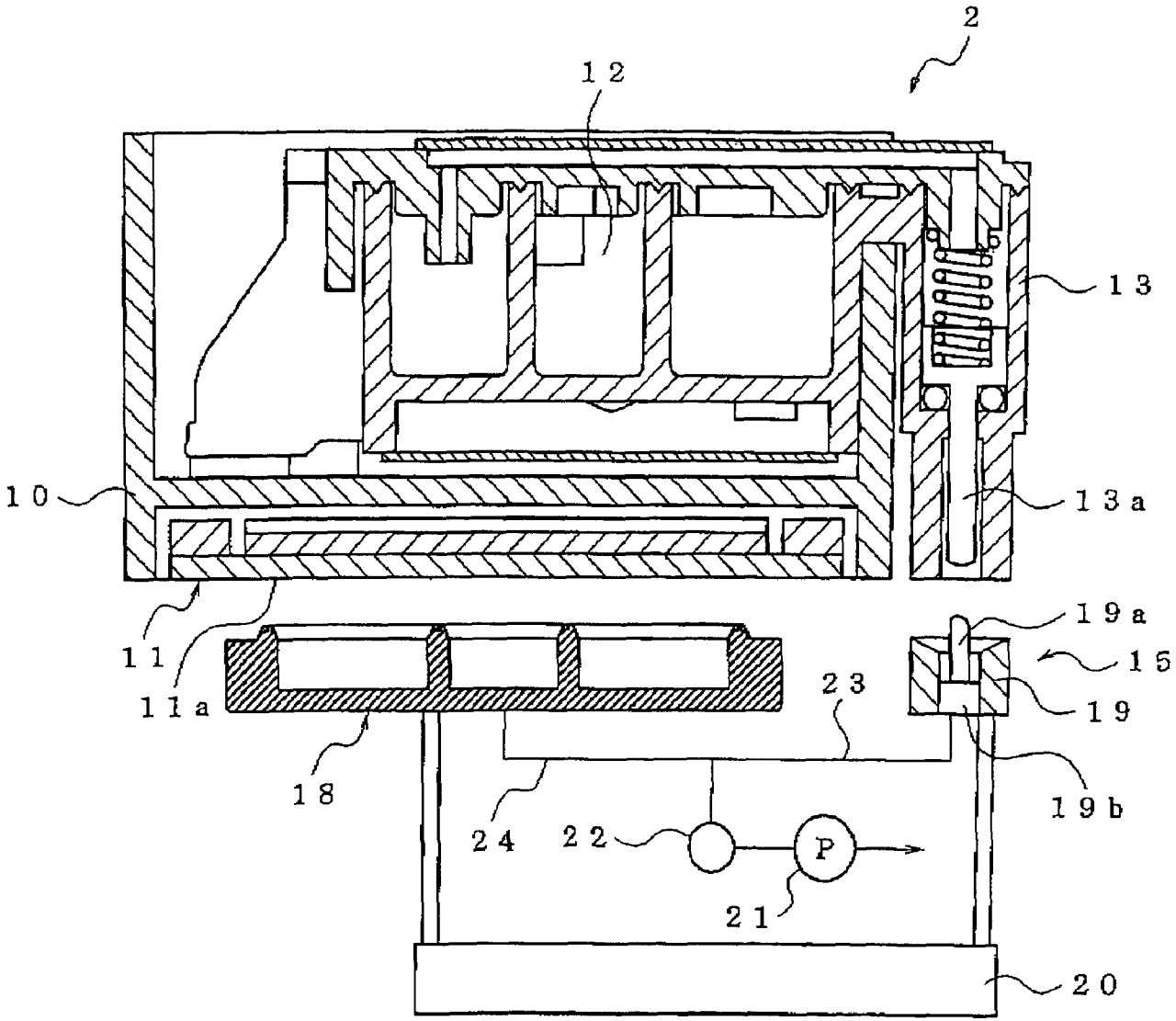
FIG. 4 is a schematic diagram illustrating the positional relationship between the recording head and a maintenance unit in the inkjet printer according to one embodiment.

As shown in the bottom view of FIG. 3 and the cross-sectional view of FIG. 4, the recording head unit 2 fixed to the carriage 5 is provided, at its bottom part, with a recording head 11 and has a box-shaped head holder 10, and a buffer tank 12 and an exhaust means 13 are located over the recording head 11. A bottom face of the head holder 10 is opened, and a lower face of the recording head 11 is exposed.

The lower face of the recording head 11 constitutes a nozzle face 11*a*, and columns of nozzles 14*b*, 14*y*, 14*c* and 14*m* for ejecting ink of black, yellow, cyan and magenta colors are provided orthogonally with respect to the reciprocating direction of the recording head unit 2. The arrangement of the columns is as follows. The two columns of the nozzles 14*b* for black color are provided at the center, and on both sides of these columns of the nozzles 14*b* for black color, the columns of the nozzles 14*y* for yellow color, the columns of the nozzles 14*c* for cyan color, and the columns of the nozzles 14*m* for magenta color are arranged outwardly in this order.

On the other hand, as shown in FIG. 2, the main body case 6 is provided, at one side of its bottom part, with a maintenance unit 15 so that the maintenance unit 15 is located directly below the passage of the carriage 5. Provided next to the maintenance unit 15 is a wiper 16 for wiping and cleaning the nozzle face 11*a* of the recording head 11.

At the other side of the bottom part of the main body case 6, an ink receiver 17 is provided to retrieve ink discharged during flushing in which ink is ejected from the nozzles 14*b*, 14*y*, 14*c* and 14*m*.

Next, the maintenance unit 16 will be described in detail with reference to FIG. 4. The maintenance unit 15 is provided with an elastic cap 18 for covering the nozzle face 11*a* of the recording head 11, and an exhaust cap 19 for sucking air bubbles accumulated in the exhaust means 13. These caps 18 and 19 can be raised and lowered selectively by a common raising and lowering means 20, and are connected to a single suction pump 21 via a single switching valve 22.

The exhaust cap 19 is provided with: an upwardly protruded release rod 19*a* for pushing up and releasing a valve rod 13*a* of the exhaust means 13; and a suction inlet 19*b* through which air bubbles are sucked from the exhaust means 13 in an opened state. The suction inlet 19*b* and the switching valve 22 are connected to each other via a suction tube 23.

Figure 5A:
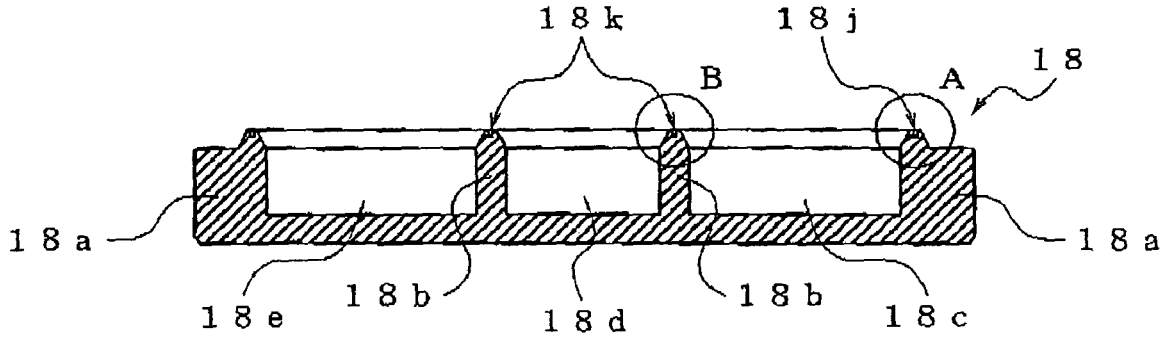
Figure 5B:
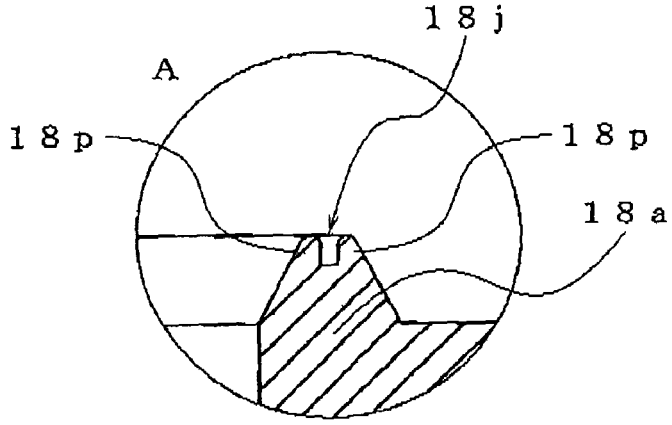
Figure 5C:
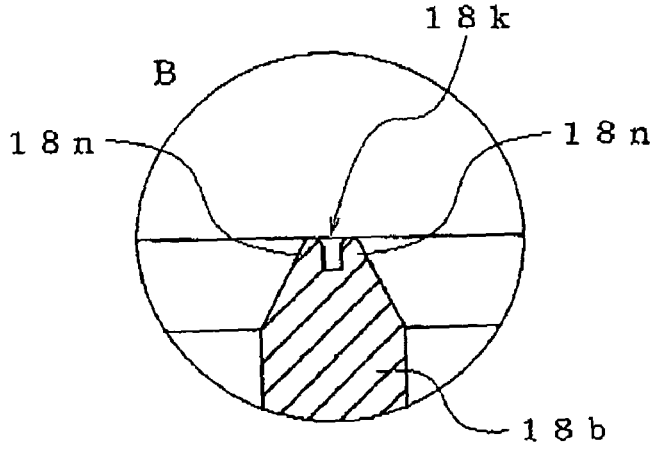

On the other hand, as shown in FIG. 3 and FIGS. 5A through 5C, the cap 18 for covering the nozzle face 11*a* of the recording head 11 is formed into a rectangular shape that is elongated in the same direction as that of the columns of the nozzles 14*b*, 14*y*, 14*c* and 14*m*, and an annular sealing lip (rim) 18*a* is provided so as to be protruded along a peripheral portion of the cap 18. It should be noted that FIGS. 5B and 5C are an enlarged view of the A area in FIG. 5A and an enlarged view of the B area in FIG. 5A, respectively.

Inside the annular sealing lip (rim) 18*a*, two partitioning lips (partitioning walls) 18*b* for longitudinally partitioning an inner space of the cap 18 are provided, and thus three chambers 18*c* through 18*e*, surrounded by the annular sealing lip (rim) 18*a* and the partitioning lips 18*b*, are formed inside the cap 18.

The annular sealing lip (rim) 18*a* and the partitioning lips (partitioning walls) 18*b* are formed to be on the same level and integral with each other. Furthermore, the lip 18*a* is provided, at an upper end thereof, with a groove (an annular groove) 18*j* while the lips 18*b* are provided, at upper ends thereof, with grooves (additional grooves) 18*k*, each groove being formed to extend along the continuing direction of the associated lip.

The groove 18*j* of the annular sealing lip 18*a* is formed so as to be circularly continuous, while the grooves 18*k* of the partitioning lips 18*b* are each formed as one continuous groove provided across the entire length of the associated one of the lips 18*b*. Both ends of each groove 18*k* of the partitioning lips 18*b* are connected to the groove 18*j* of the annular sealing lip 18*a* so as to be communicated with the groove 18*j* of the annular sealing lip 18*a*.

Furthermore, the three chambers 18*c* through 18*e* are associated with the columns of the nozzles 14*b*, 14*y*, 14*c* and 14*m* as follows. The center chamber 18*d* is associated with the columns of the nozzles 14*b* for black color, while the chambers 18*c* and 18*e*, located on both sides of the center chamber 18*d*, are each associated with the columns of the nozzles 14*y*, 14*c* and 14*m* for yellow, cyan and magenta colors.

At ends of the chambers 18*c*, 18*d* and 18*e*, suction inlets 18*f*, 18*g* and 18*h* are formed, respectively, and the suction inlets 18*f*, 18*g* and 18*h* are connected with one end of a suction tube 24, the other end of which is connected to the switching valve 22.

The cap 18 is used in the case where purge is carried out to prevent clogging of the nozzles, and/or the nozzles are preserved to prevent drying of the nozzles during non-recording time.

During capping, the upper ends of the annular sealing lip 18*a* and the partitioning lips 18*b* are abutted against the nozzle face 11*a*, thus providing a closed space between the nozzle face 11*a* and the chambers 18*c* through 18*e* inside the cap 18. Since the lip 18*a* and the lips 18*b* are provided, at the upper ends thereof, with the groove (annular groove) 18*j* and the groove (additional groove) 18*k*, respectively, the chambers 18*c* through 18*e* are doubly sealed by side walls (banks) located on both sides of the grooves 18*j* and 18*k*, thus ensuring a high sealing property in the capping (Note that the side walls of the groove 18*j* are denoted by the reference numeral 18*p*, while the side walls of the grooves 18*k* are denoted by the reference numeral 18*n*).

Accordingly, it is possible to reduce the cap load, and thus it is possible to decrease the load applied onto the nozzle face 11*a*, the head holder 10 and the like during the capping. In particular, compared with the purge, the preservation of the nozzles takes a longer capping time, and applies a larger load onto precision-made recording components such as the nozzle face 11*a* and the head holder 10; therefore, the occurrence of an adverse effect such as deformation can be effectively prevented by suppressing the cap load.

Next, a capping method that can further reduce the cap load using the cap 18 will be described. In the following description, the capping method is applied to the preservation of the nozzles by way of example, but the capping method may also be applied to the purge.

First, the timing belt 8 is driven to move the carriage 5, thus allowing the recording head 11, attached to the carriage 5, to be located above the cap 18 of the maintenance unit 16. In this case, one column of the nozzles 14*b* for black color is allowed to be located above one side of the sealing lip (rim) 18*a* extending in parallel with this column of the nozzles 14*b*.

Figure 6A:
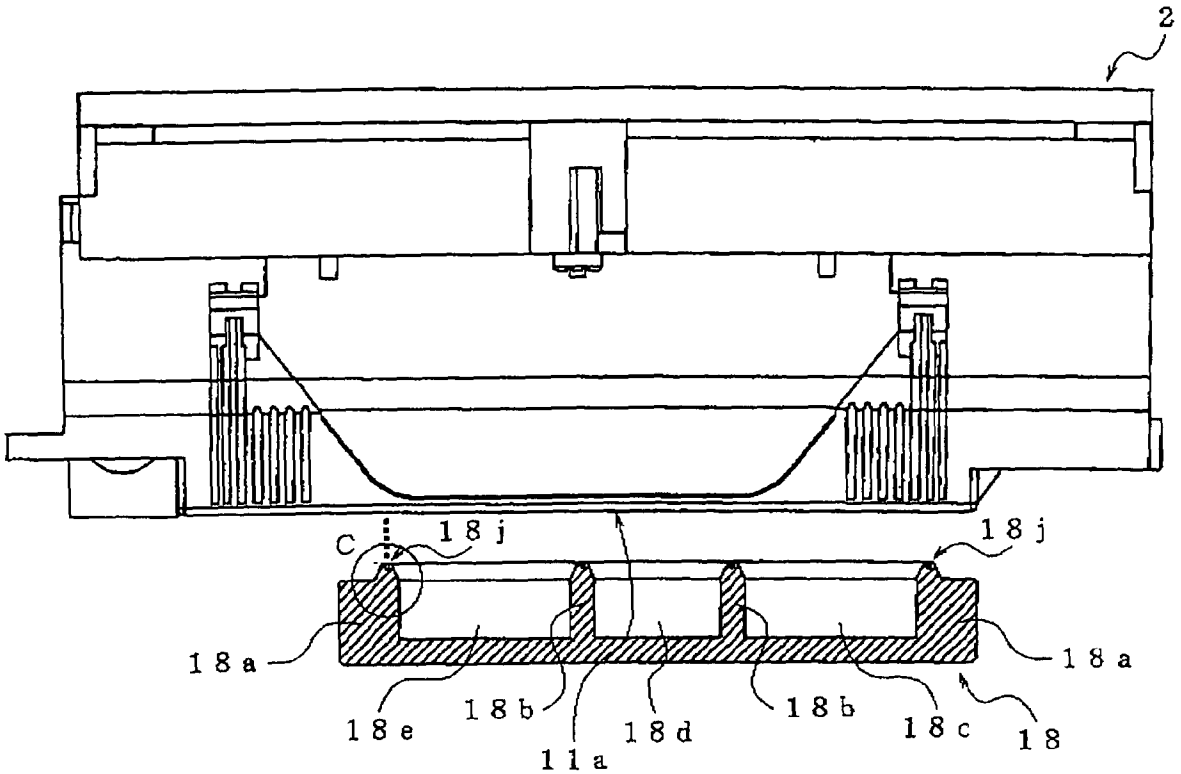
FIGS. 6A to 6B show diagrams for describing a capping method according to one embodiment, each illustrating the state where black ink is ejected toward a cap groove from a nozzle at a nozzle face of a recording head.
Figure 6B:
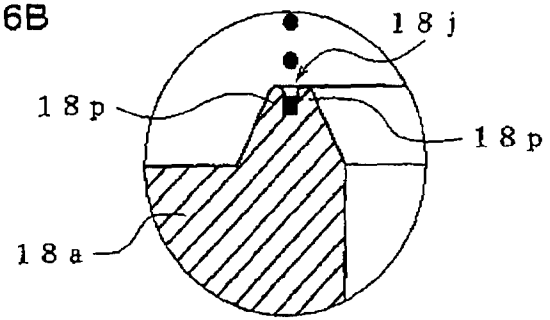

Next, the raising and lowering means 20 is driven to raise the cap 18, thus bringing the upper end of the sealing lip (rim) 18*a* close to the nozzle face 11*a*. Then, the raising of the cap 18 is stopped, and a predetermined amount of black ink is ejected onto the groove (annular groove) 18*j* from the nozzles 14*b* (see FIGS. 6A and 6B). The ink ejected from the nozzles 14*b* and supplied to the groove 18*j* is spread all around the groove 18*j* and over the entire length of the groove (additional groove) 18*k* of each partitioning lip (partitioning wall) 18*b* due to a capillary phenomenon.

Thereafter, the timing belt 8 is driven to move the carriage 5, thus aligning the positions of the nozzle face 11*a* and the cap 18. More specifically, the positional alignment is carried out so that the group of the nozzles 14*b* for black color are located above the chamber 18*d* of the cap 18, and the groups of the nozzles 14*y*, 14*c* and 14*m* for yellow, cyan and magenta colors are located above the chambers 18*c* and 18*e* of the cap 18.

Figure 7A:
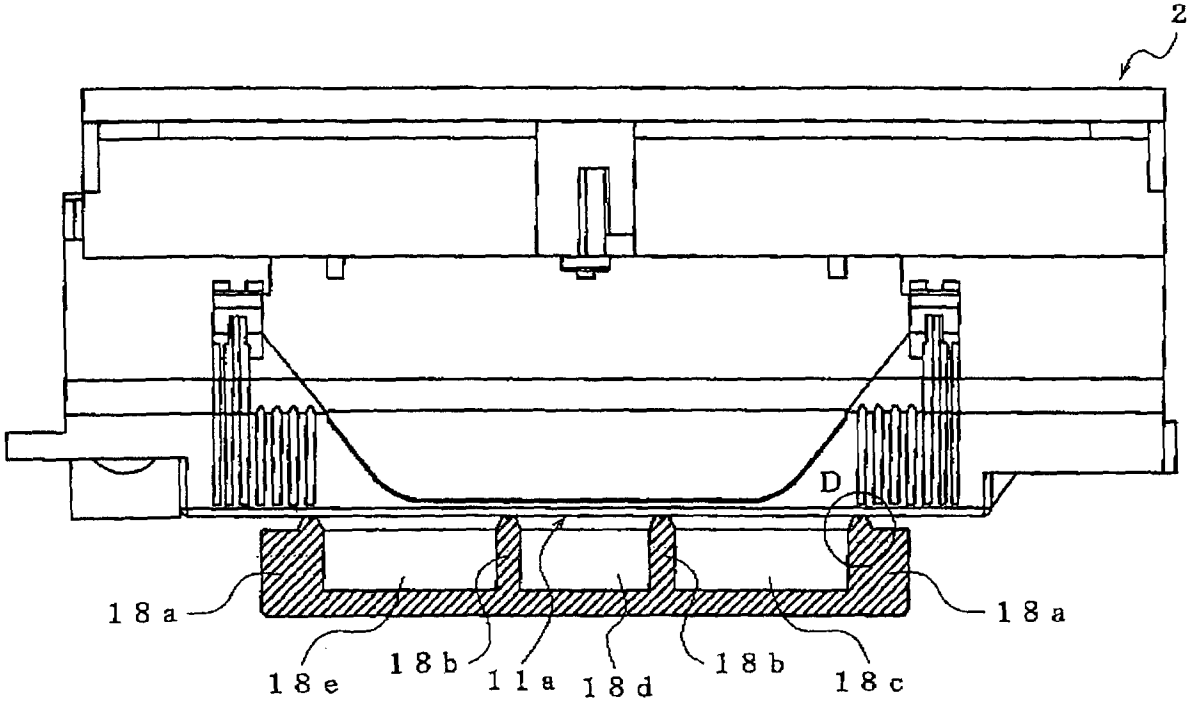
FIGS. 7A to 7B show diagrams for describing the capping method according to one embodiment, each illustrating the state where the nozzle face is capped.
Figure 7B:
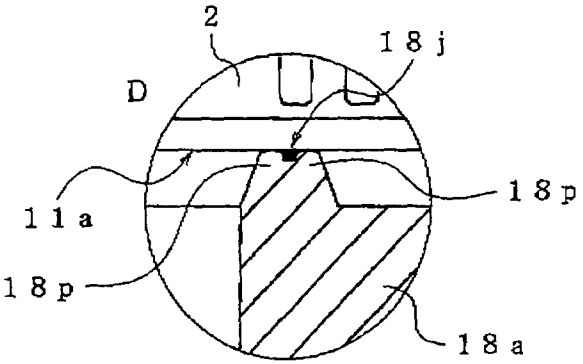

Then, the cap 18 is raised again to abut the upper ends of the annular sealing lip 18*a* and the partitioning lips 18*b* against the nozzle face 11*a*. In this case, the abutment is provided such that the black ink in the grooves 18*j* and 18*k* of the lips is brought into contact with the nozzle face 11*a*, and a gap between the grooves 18*j* and 18*k* and the nozzle face 11*a* is closed by the black ink (see FIGS. 7A and 7B). Thereafter, the cap 18 is stopped to preserve the nozzles.

If the nozzles are preserved in this manner, the chambers 18*c* through 18*e* inside the cap 18 are doubly partitioned by the side walls (banks) 18*p* of the groove (annular groove) 18*j* and the side walls (banks) 18*n* of the grooves (additional grooves) 18*k* which are provided at the respective lips, and in addition, the gap between the lip upper ends and the nozzle face 11*a* is closed by the black ink in the grooves 18*j* and 18*k* to realize an extremely high sealing property, thus effectively preventing the drying of the nozzles.

Moreover, the cap load can be reduced due to the high sealing property of the cap 18; consequently, even if the nozzles are preserved for a long period of time, substantially no load is applied onto the nozzle face 11*a* and/or the head holder 10, and an adverse effect such as deformation does not occur.

It should be noted that at the time of the capping, the nozzle face 11*a* onto which black ink is adhered is wiped and cleaned by the wiper 16.

Figure 8A:
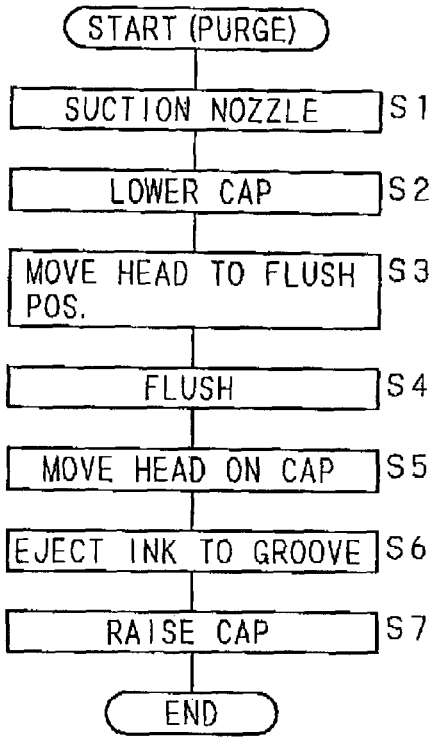
FIGS. 8A to 8B show flow charts illustrating the case where purge is carried out and the procedure of recording in the inkjet printer according to one embodiment.
Figure 8B:
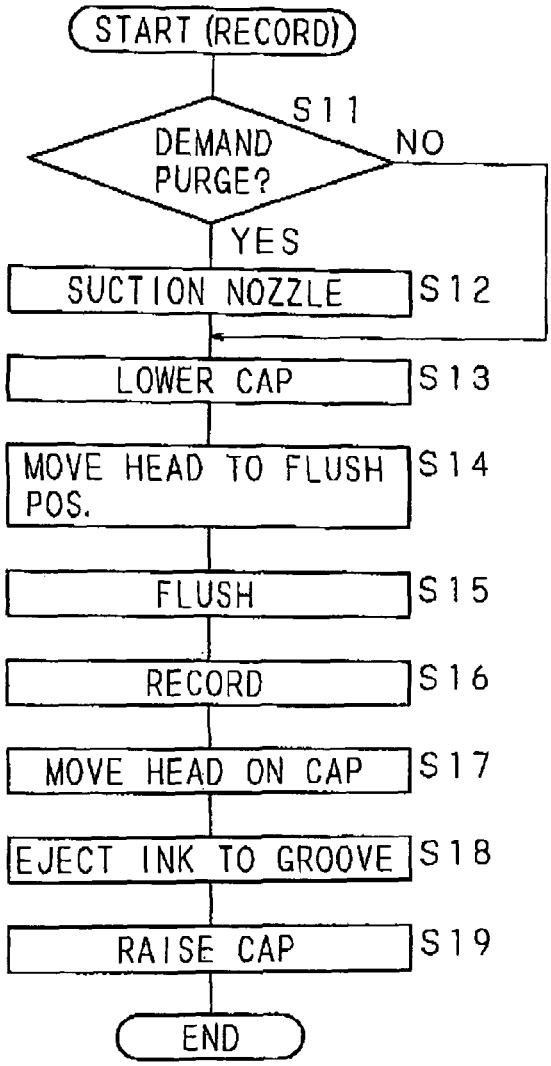

Next, the procedure in the case where only maintenance is carried out, and the procedure for carrying out recording will be described with reference to FIGS. 8. FIG. 8A is a flow chart illustrating the procedure in the case where only maintenance is carried out, and FIG. 8B is a flow chart illustrating the procedure for carrying out recording.

First, in the case where only maintenance is carried out, a purge sequence is started, and ink is sucked from the nozzles 14*b*, 14*y*, 14*c* and 14*m* at the capped nozzle face 11*a* (S1). Thereafter, the cap 18 is lowered (S2) to move the cap 18 away from the recording head 11, thereby uncapping the nozzle face 11*a*. Then, the carriage 5 is driven to move the recording head 11 to a flushing position provided at the ink receiver 17 (S3). Next, ink is ejected from each of the nozzles 14*b*, 14*y*, 14*c* and 14*m* to carry out flushing (S4). After the flushing, the carriage 5 is moved again so that the recording head 11 is located above the cap 18 of the maintenance unit 15 (S5). In this case, the nozzles 14*b* and the groove 18*j* of the annular sealing lip 18*a* are opposed to each other. Then, ink is ejected onto the groove 18*j* from the nozzles 14*b* (S6). After the ink has been supplied to the groove 18*j* in this manner, the cap 18 is raised (S7), and the nozzle face 11*a* is capped to preserve the nozzles 14*b*, 14*y*, 14*c* and 14*m*, thus completing the purge sequence.

On the other hand, in the case where recording is carried out, it is first detected whether the purge is demanded (S11), and if the purge is demanded (i.e., if the answer is Yes in (S11), ink is sucked from the nozzles 14*b*, 14*y*, 14*c* and 14*m* at the capped nozzle face 11*a* (S12). If the purge is not demanded (i.e., if the answer is NO in (S12), this operation is omitted and the procedure proceeds to the next step. After the completion of the purge, the maintenance cap 18 is lowered to uncap the recording head 11 (S13), the carriage 5 is driven to move the recording head 11 to the flushing position (S14), and ink is ejected from the nozzles 14*b*, 14*y*, 14*c* and 14*m* at the nozzle face 11*a* to carry out flushing (S15). Then, the carriage 5 is driven to move the recording head 11 to a position located above a recording paper to eject ink onto the recording paper from the nozzles 14*b*, 14*y*, 14*c* and 14*m*, thus carrying out recording (S16). After the completion of the recording, the carriage 5 is driven to move the recording head 11 to a position located above the maintenance unit 15 (S17), and ink is ejected onto the groove 18*j* from the nozzles 14*b* (S18), thus supplying the ink to the groove 18*j*. Thereafter, the cap 18 is raised (S19), and the nozzle face 11*a* is capped to preserve the nozzles 14*b*, 14*y*, 14*c* and 14*m*, thus completing a series of operations concerning the recording.

Although ink is supplied to the grooves 18*j* and 18*k* using one of the columns of the nozzles 14*b*, 14*y*, 14*c* and 14*m* in the above-described embodiment, a plurality of the nozzle columns may be used to eject and supply ink to the grooves 18*j* and 18*k*. Further, the maintenance unit 15 may additionally be provided with a means for supplying a liquid, and a liquid such as a preservation solution may be supplied from this means to the grooves 18*j* and 18*k*.

Figure 9A:
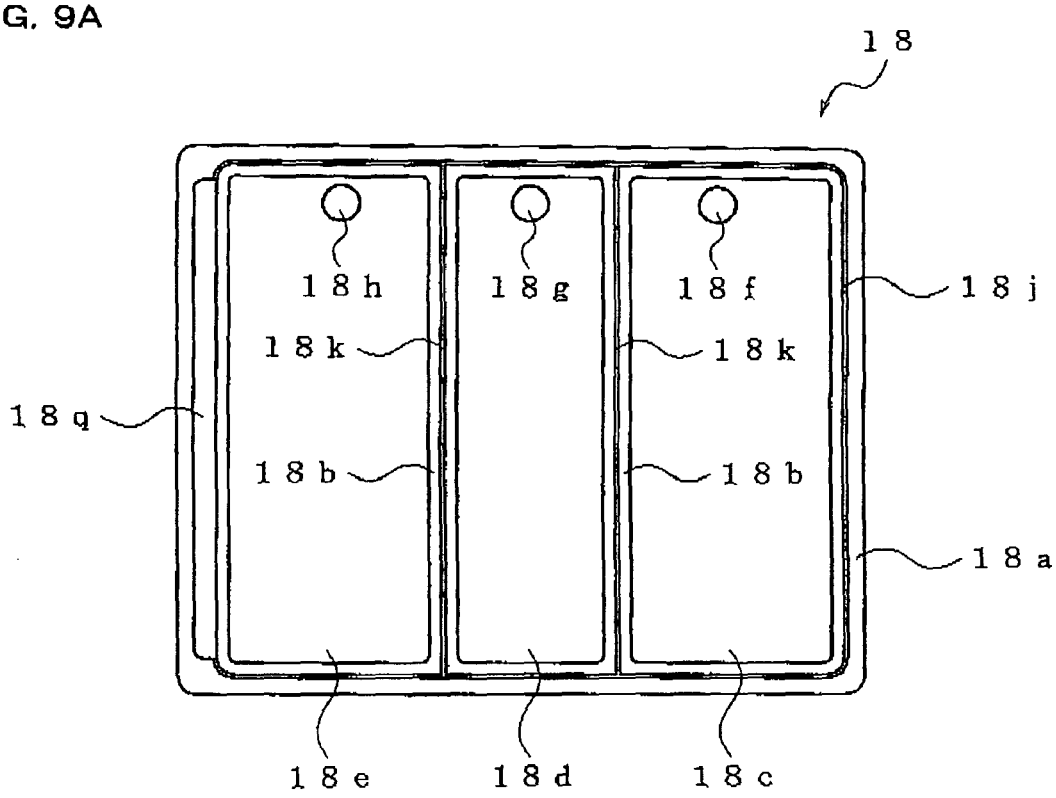
FIGS. 9A to 9B show plan views each illustrating a modification of the cap of the inkjet printer according to one embodiment.

Furthermore, for example, the shape of the cap 18 may be modified as follows. In the cap 18 shown in FIG. 9A, the shape of the annular sealing lip 18*a* is modified such that an ink receiver 18*q* is provided at one side of the groove 18*j*, located to extend in parallel with the columns of the nozzles 14*b*, 14*y*, 14*c* and 14*m* of the recording head 11, by widening the groove width.

Thus, the supply of a liquid to the grooves 18*j* and 18*k* is facilitated, and if ink is supplied from the nozzles as in the foregoing embodiment, the ink receiver 18*q* can absorb the ink deflected due to a slight misalignment of the column of the nozzles 14*b* for ejecting ink with respect to the groove 18*j*, thus ensuring the supply of the ink. Further, although not shown, in addition to the annular sealing lip 18*a* or the partitioning lips 18*b*, an ink supply part including an ink supply passage communicated with the grooves 18*j* and 18*k* may be provided.

A ink receiver may be formed by widening the groove 18*k* of the partitioning lip 18*b*.

Figure 9B:
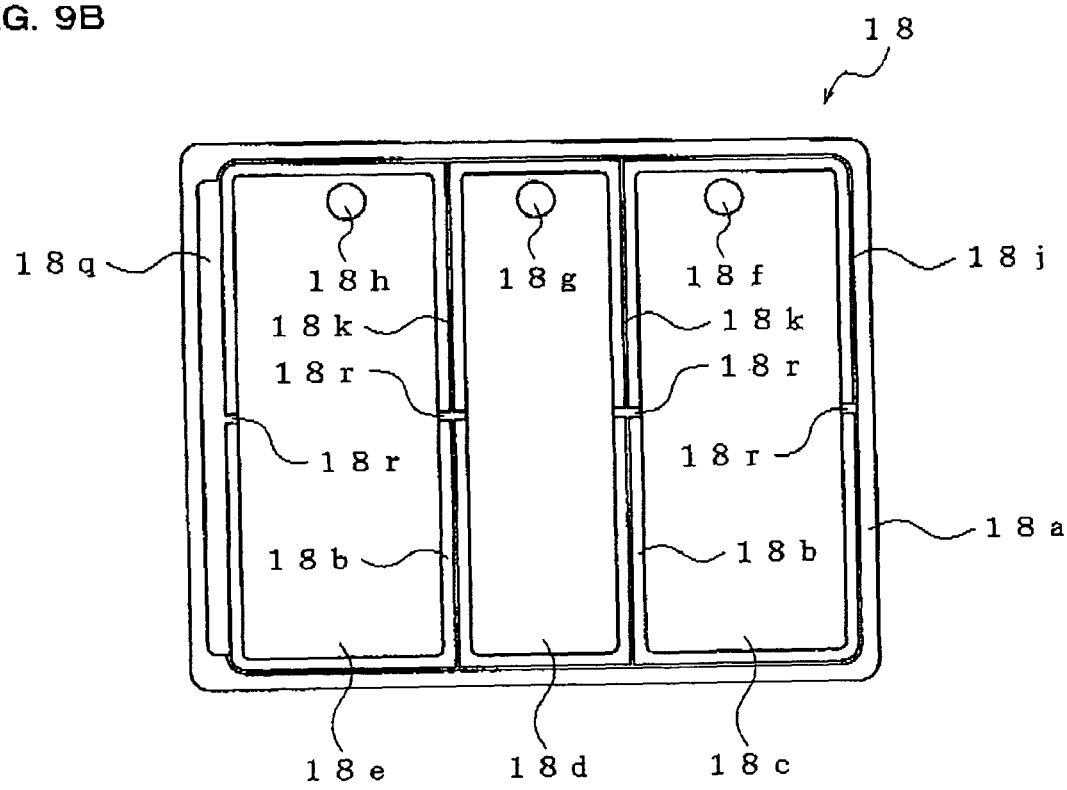

In another modification shown in FIG. 9B, the side walls of the grooves 18*j* and 18*k* are partially provided with cutouts 18*r*. Due to the cutouts 18*r*, a liquid remaining in the grooves 18*j* and 18*k* can be sucked and discharged during the purge. Furthermore, since an excessively supplied liquid is discharged through the cutouts 18*r*, a constant amount of liquid can always be supplied to the grooves 18*j* and 18*k*. Since the cutouts 18*r* are provided at the side walls located inside the chambers 18*c* through 18*e*, a liquid in the grooves 18*j* and 18*k* does not leak out of the cap 18.

In the inkjet printer according to one embodiment, since the partitioning lips are provided, the suction of each kind of the ink is enabled when the ink is sucked from the nozzles; in addition, since the grooves are formed at the lip upper ends, the sealing property for the respective chambers inside the cap, partitioned by the partitioning lips, is increased. This is because if the upper ends of the partitioning lips are abutted against the nozzle face, each of the chambers is doubly partitioned by the side walls on both sides of each groove.

This inkjet printer is characterized in that the groove of the annular sealing lip is provided so as to be circularly continuous, the groove of each partitioning lip is provided so as to be continuous across the entire length thereof, and the groove of the annular sealing lip is continuous with the grooves of the partitioning lips.

This inkjet printer can further improve the sealing property for each chamber surrounded by the annular sealing lip and the partitioning lips which are formed inside the cap. This is because, since the groove of the annular sealing lip is continuous with the grooves of the partitioning lips, it is ensured that each chamber is doubly partitioned by the side walls located on both sides of each groove upon abutment of each lip upper end against the nozzle face.

A capping method according to one embodiment is based on a capping method in which a recording head having a nozzle face, at which a plurality of nozzles for ejecting ink are formed, is covered with a cap. First, the recording head is moved to a position at which the cap is located so that the recording head and the cap are opposed to each other.

Next, a liquid is supplied to a groove that is formed at an upper end of an annular sealing lip, provided at the cap, so as to extend along the continuing direction of the lip, and the cap is moved toward the recording head.

Then, the upper end of the annular sealing lip is abutted against the nozzle face of the recording head to deform the upper end of the annular sealing lip, and the movement of the cap is stopped in the state where the liquid in the groove is brought into contact with the nozzle face, thus holding the cap at this stopped position.

According to such a capping method, since the liquid is supplied to the groove of the annular sealing lip, the inside of the cap is doubly partitioned by the side walls on both sides of the grooves, and in addition, a gap between the nozzle face and the upper end of the annular sealing lip is closed with the liquid, thus enabling the capping that realizes a high sealing property even if the. cap load is A capping method according to one embodiment is characterized in that a liquid is supplied not only to a groove of an annular sealing lip, but also to a groove formed at an upper end of a partitioning lip, by which the inside of the annular sealing lip is partitioned for each kind of ink sucked from a nozzle, so as to extend along the continuing direction of the partitioning lip, and the movement of the cap is stopped in the state where the liquid in the grooves of the annular sealing lip and the partitioning lip is brought into contact with the nozzle face.

According to this capping method, each chamber inside the cap surrounded by the annular sealing lip and the partitioning lip is doubly partitioned by the side walls on both sides of the groove provided at each lip upper end, and in addition, a gap between each lip upper end and the nozzle face is closed by the liquid. Accordingly, even if the cap load is small, the capping in which the sealing property for each chamber is high can be provided.

A capping method according to one embodiment is characterized in that a groove of a sealing lip is formed so as to be circularly continuous while a groove of a partitioning lip is formed so as to be continuous across the entire length thereof, and the groove of the sealing lip and the groove of the partitioning lip are continuous with each other, thus distributing the liquid, supplied to either the groove of the sealing lip or the groove of the partitioning lip, to the other groove.

According to such a capping method, since it is only necessary to supply the liquid to either the groove of the annular sealing lip or the groove of the partitioning lip, there is no need to supply the liquid for each lip. Furthermore, since a means for supplying the liquid does not have to be provided for each lip, the resulting device can be simplified.

For example, a capillary phenomenon may be utilized to distribute the liquid to the grooves of the respective lips.

A capping method for a recording head according to one embodiment is characterized in that a liquid to be used is an ink ejected from a nozzle, and after the cap has been brought close to a recording head, the ink is ejected onto a groove from the nozzle so as to supply the ink to the groove. According to such a capping method, since a printer does not have to be additionally provided with a means for supplying the liquid, it is possible to avoid the complication of the resulting device.

A capping method for a recording head according to one embodiment is characterized in that the method is used during non-recording time of a recording head. According to such a capping method, since it is ensured that a cap realizes a high sealing property even if a cap load is small, it is possible to preserve a nozzle without applying any load to the recording head, a holder of the recording head and the like.

In an inkjet printer according to one embodiment, since the sealing property for each chamber inside a cap surrounded by an annular sealing lip and a partitioning lip is increased, a cap load can be further reduced, thus enabling capping in which only a small load is applied to a precision-made recording component. Furthermore, as for the cap, an adverse deformation of the lips is unlikely to occur.

A capping method according to one embodiment enables capping in which substantially no load is applied to precision-made recording components such as a nozzle face and a head holder.

A capping method according to one embodiment can omit the step of supplying a liquid to either a groove of an annular. sealing lip or a groove of a partitioning lip, thus facilitating the formation of a sequence. In addition, since there is no need to provide a means for supplying a liquid to the groove of each lip, the structural simplification can be provided, thus reducing the effort of design and fabrication.

A capping method according to one embodiment can be used for various applications by mainly just changing a part of a sequence, thus reducing the effort of design and fabrication.

A capping method according to one embodiment allows a nozzle to be preserved for a long period of time without causing any adverse effect such as deformation to precision components such as a nozzle face and a head holder.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. An inkjet printer comprising:

a recording head having a nozzle face provided with a nozzle for discharging an ink to form an image on a recording medium; and a detachable cap for capping the nozzle face, the cap including an annular rim and an annular groove which are provided along a periphery of the cap, the groove being opposed to the nozzle face in a state where the cap is abutted against the nozzle face;

wherein the annular groove is disposed in an end portion of the annular rim, and has two banks of equal height; and wherein the cap is configured by the printer to cap the nozzle face in a state where the groove is supplied with a liquid.

2. The inkjet printer according to claim 1;

wherein a during non-image-forming period, the rim of the cap is abutted against the nozzle face, thus capping the nozzle face.

3. The inkjet printer according to claim 1;

wherein in the state where the nozzle face is capped by the cap, the two banks are abutted against the nozzle face, and the groove is surrounded by the two banks and the nozzle face.

4. The inkjet printer according to claim 3;

wherein one of the two banks has a notch such that the groove communicates with an inside of the rim.

5. The inkjet printer according to claim 1;

wherein a plurality of nozzles are provided; and wherein the cap includes:

a partitioning wall for partitioning an inside of the rim into a plurality of sections; and an additional groove provided at the partitioning wall so as to be opposed to the nozzle face in a state where the cap is abutted against the nozzle face.

6. The inkjet printer according to claim 5;

wherein during a non-image-forming period, the rim and partitioning wall of the cap are abutted against the nozzle face, thus capping the nozzle face.

7. The inkjet printer according to claim 6;

wherein the annular groove and the additional groove are communicated with each other.

8. The inkjet printer according to claim 5;

wherein the annular groove and the additional groove are communicated with each other.

9. The inkjet printer according to claim 5;

wherein the plurality of nozzles are associated with the respective sections.

10. The inkjet printer according to claim 5;

wherein the cap further includes an ink receiving portion for receiving the ink discharged from the nozzle, the ink receiving portion being communicated with one of the annular groove and additional groove.

11. The inkjet printer according to claim 10;

wherein the rim includes two banks between which the annular groove is disposed and the partitioning wall includes two banks between which the additional groove is disposed; and wherein a width dimension of the ink receiving portion is greater than both width dimensions of the annular groove and additional groove each of which is a gap dimension between the corresponding two banks.

12. The inkjet printer according to claim 10;

wherein the ink receiving portion is formed by widening a part of one of the annular groove and additional groove up to a predetermined width dimension.

13. The inkjet printer according to claim 5;

wherein the partitioning wall has a notch such that the additional groove communicates with at least one of the plurality of the sections.

14. A capping method for capping a nozzle face, provided with a nozzle for discharging an ink to form an image on a recording medium, by using a detachable cap including an annular rim and an annular groove which are provided along a periphery of the cap, the groove being opposed to the nozzle face in a state where the nozzle face is capped by the cap, the method comprising the steps of:

opposing the nozzle face to the cap; intentionally supplying a liquid to the groove;

abutting the rim against the nozzle face by moving the cap toward the nozzle face; and holding a position of the cap.

15. The capping method according to claim 14;

wherein the rim is made of an elastic material; and wherein when the rim is abutted against the nozzle face, an abutted edge of the rim is elastically deformed.

16. The capping method according to claim 14; wherein the rim includes two banks between which the groove is disposed; and wherein the step of abutting the rim includes the step of sealing the liquid in a space defined by surrounding the groove with the two banks and the nozzle face.

17. The capping method according to claim 14; wherein the liquid is the ink; and wherein the step of supplying the liquid includes the step of discharging the ink toward the groove from the nozzle.

18. The capping method according to claim 14;

wherein a plurality of nozzles are provided, and wherein the cap includes:

a partitioning wall for partitioning an inside of the rim into a plurality of sections; and an additional groove provided at the partitioning wall so as to be opposed to the nozzle face in a state where the cap is abutted against the nozzle face.

19. The capping method according to claim 18; wherein the step of supplying the liquid includes the step of supplying the liquid to the annular groove and the additional groove.

20. The capping method according to claim 19; wherein the liquid is the ink; and wherein the step of supplying the liquid includes the step of discharging the ink toward the annular groove and the additional groove from the nozzle.

21. The capping method according to claim 18; wherein the annular groove and the additional groove are communicated with each other; and wherein the step of supplying liquid includes the step of supplying the liquid to either the annular groove or the additional groove.

22. The capping method according to claim 21; wherein the liquid is the ink; and wherein the step of supplying the liquid includes the step of discharging the ink toward either the annular groove or the additional grove from the nozzle.

23. The capping method according to claim 18;

wherein the cap further includes an ink receiving portion for receiving the ink discharged from the nozzle, the ink receiving portion being communicated with one of the annular groove and additional groove;

wherein the step of opposing the nozzle face to the cap includes a step of adjusting the nozzle over the ink receiving portion such that the ink is discharged in the ink receiving portion; and wherein the step of supplying a liquid to the groove includes a step of discharging the ink in the ink receiving portion.

24. The capping method according to claim 23;

wherein the rim includes two banks between which the groove is disposed and the partitioning wall includes two banks between which the additional groove is disposed; and wherein a width dimension of the ink receiving portion is greater than both width dimensions of the annular groove and additional groove each of which is a gap dimension between the corresponding two banks.

25. The capping method according to claim 23;

wherein the ink receiving portion is formed by widening a part of one of the annular groove and additional groove up to a predetermined width dimension.

26. The capping method according to claim 14;

wherein the capping method is used during a non-image-forming period.

27. The capping method according to claim 14;

wherein the cap further includes an ink receiving portion for receiving the ink discharged from the nozzle, the ink receiving portion being connected to the groove;

wherein the step of opposing the nozzle face to the cap includes a step of adjusting the nozzle over the ink receiving portion such that the ink is discharged in the ink receiving portion; and wherein the step of supplying a liquid to the groove includes a step of discharging the ink in the ink receiving portion.

28. The capping method according to claim 27;

wherein the rim includes two banks between which the groove is disposed; and wherein a width dimension of the ink receiving portion is greater than a width dimension of the groove which is a gap dimension between the two banks.

29. The capping method according to claim 27;

wherein the ink receiving portion is formed by widening a part of the groove on the rim up to a predetermined width dimension.

30. An inkjet printer comprising:

a recording head having a nozzle face provided with a nozzle for discharging an ink to form an image on a recording medium; and a detachable cap for capping the nozzle face, the cap including an annular rim and an annular groove which are provided along a periphery of the cap, the groove being opposed to the nozzle face in a state where the cap is abutted against the nozzle face;

wherein the cap further includes an ink receiving portion for receiving the ink discharged from the nozzle, the ink receiving portion being communicated with the groove.

31. The inkjet printer according to claim 30;

wherein the rim includes two banks between which the groove is disposed; and wherein a width dimension of the ink receiving portion is greater than a width dimension of the groove which is a gap dimension between the two banks.

32. The inkjet printer according to claim 30;

wherein the ink receiving portion is formed by widening a part of the groove on the rim up to a predetermined width dimension.

33. An inkjet printer comprising:

a recording head having a nozzle face provided with a nozzle for discharging an ink to form an image on a recording medium; and a detachable cap for capping the nozzle face, the cap including an annular rim and an annular groove which are provided along a periphery of the cap, the groove being opposed to the nozzle face in a state where the cap is abutted against the nozzle face;

wherein the annular groove is disposed in an end portion of the annular rim, and has two banks of equal height;

wherein, in a state where the nozzle face is capped by the cap, the two banks are abutted against the nozzle face, and the groove is surrounded by the two banks and the nozzle face; and wherein an inside bank of the two banks has a notch such that the groove communicates with an inside of the rim, and an outside bank of the two banks has no notch.

* * * * *